United States Patent [19]

Blanchard

[11] 3,982,496

[45] Sept. 28, 1976

[54] SEAL AND ISOLATION MOUNTING SYSTEM

[75] Inventor: Clarence E. Blanchard, Kenosha, Wis.

[73] Assignee: Outboard Marine Corporation, Waukegan, Ill.

[22] Filed: Nov. 17, 1975

[21] Appl. No.: 632,267

Related U.S. Application Data

[63] Continuation-in-part of Ser. No. 482,468, June 24, 1974.

[52] U.S. Cl. ..... 115/.5 S; 115/34 R

[51] Int. Cl.[2] ..... B63H 5/00

[58] Field of Search ..... 115/34 R, 35, .5 S; 16/2; 277/178; 248/56; 285/192, 193

[56] References Cited

UNITED STATES PATENTS

| | | | |
|---|---|---|---|
| 2,633,817 | 4/1953 | Pedranti | 115/35 X |
| 2,977,923 | 4/1961 | Bergstedt | 115/34 R |
| 3,204,598 | 9/1965 | Sharp | 115/34 R |
| 3,327,675 | 6/1967 | Humphreys | 115/35 |

*Primary Examiner*—Trygve M. Blix
*Assistant Examiner*—Sherman D. Basinger
*Attorney, Agent, or Firm*—Michael, Best & Friedrich

[57] ABSTRACT

Disclosed herein is a marine propulsion device comprising a mounting plate adapted to be secured to the bottom of a boat hull in watertight relation and having therein an endless surface defining an opening, and a margin extending from the endless surface, a resilient member comprising an annular sealing portion including an endless surface defining a central opening and a plurality of angularly spaced extensions which project outwardly from the annular sealing portion and constitute elastomeric mounts, a clamping member including an annular portion located within the central opening of the resilient member and defining a central opening, and a flange portion extending outwardly from the annular portion, a lower unit extending through the opening in the clamping member and including a mounting flange, and means securing the clamping member to the mounting flange with the annular sealing portion of the resilient member located between the mounting plate and at least one of the lower unit mounting flange and the clamping member so as thereby to effect a watertight seal between the lower unit and the mounting plate and with the extensions located between the margin of the mounting plate opening and one of the lower unit mounting flange and the clamping member flange so as thereby to support and vibrationally isolate the lower unit from the mounting plate.

14 Claims, 2 Drawing Figures

SEAL AND ISOLATION MOUNTING SYSTEM

RELATED APPLICATION

This application is a continuation-in-part of my earlier application Ser. No. 482,468, filed June 24, 1974, and entitled "MARINE PROPULSION DEVICE ADAPTED FOR A SAILBOAT", and is related to my application Ser. No. 632268 filed Nov. 17, 1975.

BACKGROUND OF THE INVENTION

The invention relates generally to marine propulsion devices and more particularly to marine propulsion devices adapted to be fixedly mounted in a boat hull such as, for instance, in a sailboat hull.

The invention also relates to arrangements for mounting such marine propulsion devices in boat hulls.

Still further, the invention relates to constructions such as shown in my earlier above-identified application Ser. No. 482,468.

Attention is directed to U.S. Pat. No. 3,194,205 issued July 13, 1965 and to U.S. Pat. No. 3,190,254 issued June 22, 1965.

SUMMARY OF THE INVENTION

The invention provides a marine propulsion device adapted to be supported in a boat hull and to extend through an opening in the bottom of the boat hull, which device comprises a marine propulsion lower unit extending through the opening in the boat hull and including a mounting flange, a clamping member including an annular portion located within the opening in the boat hull and defining a central opening through which the lower unit extends, which clamping member also includes a flange portion extending outwardly from the annular portion, together with a resilient member including an annular sealing portion having an endless surface defining a central opening located outwardly of the annular portion of the clamping member, which resilient member also includes a plurality of angularly spaced extensions which project from said annular sealing portion and constitute elastomeric mounts, and means securing the clamping member to the mounting flange with the annular sealing portion of the resilient member located between the mounting flange of the lower unit and the flange portion of the clamping member.

The invention also provides a marine propulsion device comprising a mounting plate adapted to be secured to the bottom of a boat hull in water-tight relation and having therein an endless surface defining an opening, and a margin extending from the endless surface, a resilient member comprising an annular sealing portion including an endless surface defining a central opening and a plurality of angularly spaced extensions which project outwardly from the annular sealing portion and constitute elastomeric mounts, a clamping member including an annular portion located within the central opening of the resilient member and defining a central opening and a flange portion extending outwardly from the annular portion, a lower unit extending through the opening in the clamping member and including a mounting flange, and means securing the clamping member to the mounting flange with the annular sealing portion of the resilient member located between the mounting plate and at least one of the lower unit mounting flange and the clamping member so as thereby to effect a watertight seal between the lower unit and the mounting plate and with the extensions located between the margin of the mounting plate opening and one of the lower unit mounting flange and the clamping member flange so as thereby to support and vibrationally isolate the lower unit from the mounting plate.

The invention also provides a boat comprising a hull including therein a bottom having therein an endless surface defining an opening, and a margin extending from the endless surface, a resilient member comprising an annular sealing portion including an endless surface defining a central opening and a plurality of angularly spaced extensions which project outwardly from the annular sealing portion and constitute elastomeric mounts, a clamping member including an annular portion located within the central opening of the resilient member and defining a central opening and a flange portion extending outwardly from the annular portion, a marine propulsion lower unit extending through the opening in the clamping member and including a mounting flange, and means securing the clamping member to the mounting flange with the annular sealing portion of the resilient member located between the boat hull bottom and at least one of the lower unit mounting flange and the clamping member so as thereby to effect a watertight seal between the lower unit and the boat hull and with the extensions located between the margin of the boat hull opening and one of the lower unit mounting flange and the clamping member flange so as thereby to support and vibrationally isolate the lower unit from the boat hull.

In one embodiment in accordance with the invention, the boat further includes a mounting plate secured to the margin of the boat hull bottom opening and including therein an endless surface defining a central opening and a margin extending from the central opening of the mounting plate, said mounting plate being engaged by said resilient member to partially provide the watertight seal and to support and vibrationally isolate said lower unit from said boat hull.

In one embodiment in accordance with the invention, the sealing portion of the resilient member has greater softness than the extensions.

In one embodiment in accordance with the invention, the annular portion of the resilient member includes opposed top and bottom surfaces, an inner endless surface extending between the top and bottom surfaces and defining a central opening, and an outer endless surface extending between the top and bottom surfaces and including therein, between the top and bottom surfaces, an annular recess receiving the margin of said boat hull bottom opening. Preferably, the recess comprises an annular groove located centrally between the top and bottom surfaces.

In one embodiment of the invention, the annular portion of the resilient member includes a forward end, a rearward end, and right and left sides extending between the ends, and the plurality of extensions includes a first extension projecting from one of the forward and rearward ends of the annular portion of the resilient member and a pair of extensions projecting respectively from the left and right sides of the annular portion adjacent to the other of the forward and rearward ends.

In one embodiment in accordance with the invention, the securing means comprises a plurality of bolts extending through the mounting flange and into the annular portion of the clamping member.

One of the principal features of the invention is the provision of a mounting arrangement for a marine propulsion device extending through an opening in the bottom of a boat hull, which arrangement serves to support and vibrationally isolate the marine propulsion device from the boat hull and to provide a seal preventing entry of water into the boat hull through the mounting arrangement.

Another of the principal features of the invention is the provision of a mounting arrangement as referred to in the preceding paragraph, which arrangement includes an integrally constructed resilient member which cooperates with other parts to provide the supporting, vibration isolating, and sealing functions.

Still another of the principal features of the invention is the provision of a resilient member as referred to in the preceding paragraph, which resilient member is fabricated of resilient material and which includes both a sealing portion and a plurality of mount portions extending from the sealing portion and having lesser softness or flexibility than the sealing portions.

Still another of the principal features of the invention is the provision of a boat including a marine propulsion device which extends through an opening in the boat bottom and which is supported by a resilient member which additionally serves to vibrationally isolate the boat hull from the marine propulsion device, while at the same time, providing a watertight seal against the entry of water into the boat hull through the mounting arrangement.

Other features and advantages of the embodiments of the invention will become known by reference to the following general description, and claims, and the accompanying drawings.

THE DRAWINGS

Figure 1:
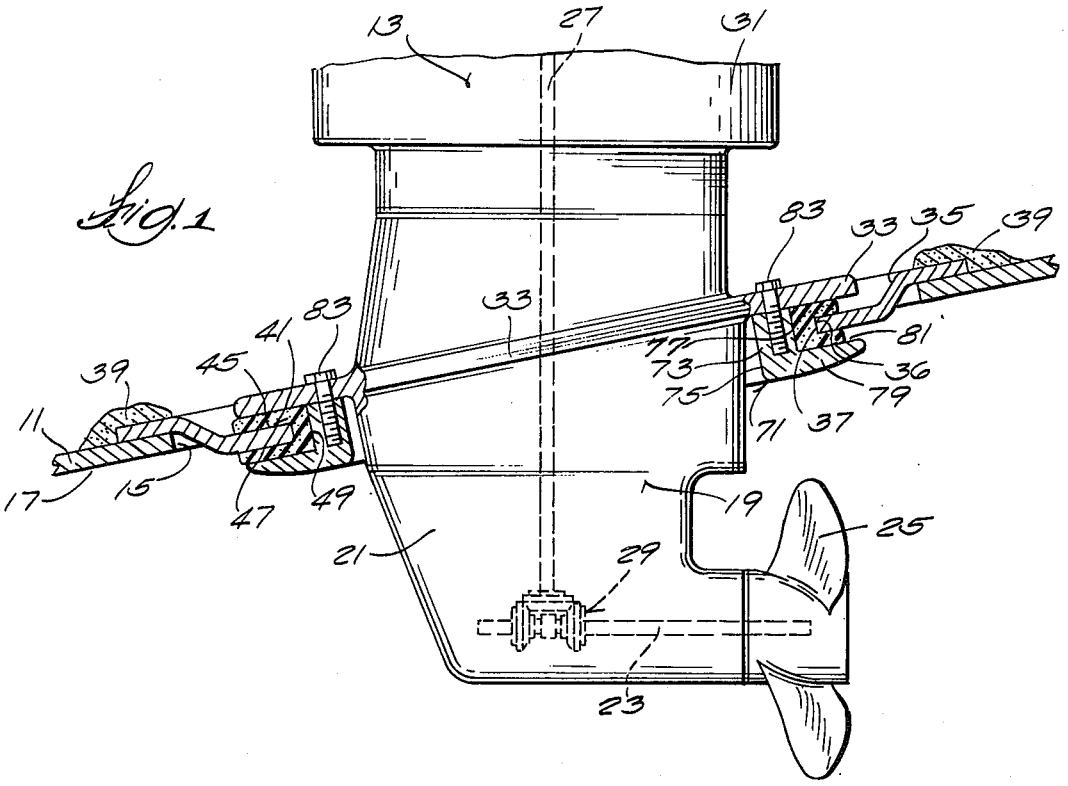
FIG. 1 is a schematic side elevational view of a marine propulsion mounting arrangement embodying various of the features of the invention.
Figure 2:
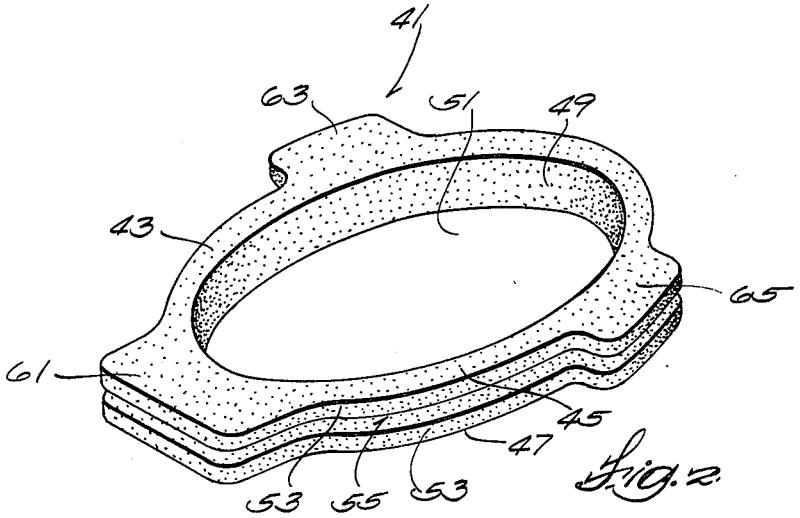
FIG. 2 is a prospective view of a component included in the mounting arrangement shown in FIG. 1.

Before explaining the embodiments of the invention in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

GENERAL DESCRIPTION

Shown in the drawings is a boat hull 11 having mounted therein a marine propulsion device 13 which projects through an opening 15 in the bottom 17 of the boat hull 11. In general, the marine propulsion device may take various forms and, in the illustrated construction, the marine propulsion device 13 includes a modified outboard motor lower unit 19 including an outer housing 21 which supports a propeller shaft 23 carrying a propeller 25. The housing 21 also supports an interiorly located drive shaft 27 which is connected to the propeller shaft 23 by suitable gearing 29. In addition, the drive shaft 27 is also connected to an engine 31 rigidly connected to the top of the lower unit 19.

The housing 21 also includes an annularly or circumferentially extending mounting flange 33. When the housing 21 is mounted, as will be explained, the lower unit 19 is fixedly connected to the boat hull 11. A more detailed explanation of the construction of one example of a marine propulsion device such as that shown in the drawings is contained in my earlier U.S. Application Ser. No. 482,468 filed June 24, 1974 and incorporated herein by reference.

Means are provided for resiliently mounting the lower unit 19 from the boat hull 11 so as to substantially vibrationally isolate the boat hull 11 from engine and lower unit vibration and, at the same time, to prevent entry of water into the boat hull 11 through the mounting. As already indicated, such mounting means includes the opening 15 in the bottom 17 of the boat hull 11, which opening 15 is preferably of elongated circular form. Preferably, there is connected to the margin of the opening 15 a ring member or mounting plate 34 which is suitably fixed to the boat hull 11 to prevent entry of water therebetween. The ring member or mounting plate 35 includes an inner endless surface 36 defining an elongated circular central opening 37 and is preferably formed of aluminum. Various arrangements can be employed to fix the ring member 35 to the boat hull 11. In the illustrated construction, the bottom of the boat hull 11 is fabricated of fiber glass and the ring member 35 is fixed to the boat hull bottom 17 by fiber impregnated resin 39 which is united to the boat hull 11. One or more through bolts (not shown) can also be employed to insure fixed connection of the ring member or mounting plate 35 to the boat hull 11.

If desired, the boat hull opening 15 can be fabricated so as to omit the ring member 35, provided that the opening 15 in the boat hull 11 is sufficiently smooth and is properly dimensioned and so long as the margin about the boat hull opening 15 is sufficiently strong to adequately support the weight of the marine propulsion device and to accept the thrust produced thereby. In any event, the opening in the ring member 35 can be considered an opening in the boat hull bottom 17.

The mounting means also includes an annular member 41 of resilient material such as rubber, which, member 41 serves both to provide a seal and to elastomerically mount the lower unit 19 from the boat hull 11. While various constructions are possible, in the illustrated construction, the annular member 41 comprises an annular or sealng portion 43 including opposed top and bottom surfaces 45 and 47, an inner endless surface 49 which extends between the top and bottom surfaces 45 and 47 and which defines an elongated circular opening 51, and an outer endless surface 53 which extends between the top and bottom surfaces 45 and 47 and which includes a recess which is preferably in the form of an annular groove 55 which is preferably located centrally between the top and bottom surfaces and receives the margin of the central opening 37 in the ring member 35.

In order to support and, at the same time, to substantially vibrationally isolate the marine propulsion device 13 from the boat hull 11, the annular member 41 also integrally includes a plurality of mounting pads or mounts which project outwardly from the annular portion 43 and which, in the illustrated construction, are three in number and are annularly located around the perimeter of the annular portion 43 so as to support and vibrationally isolate the lower unit 19 from the boat hull 11. Thus, in the illustrated construction, the annular member 41 includes a first extension or mount 61 which provides a mounting and isolating pad at the front end of the annular member 41, together with two laterally and oppositely projecting extensions or mounts 63 and 65 which are located at the right and left sides of the annular member 41 toward the rear thereof.

Also included in the mounting means is a clamping ring or member 71 which includes an annular portion 73 having an inner surface 75 defining an elongated circular opening through which the lower unit 19 projects, and a radially outwardly facing outer surface 77. The clamping member or ring 71 also includes a flange portion 79 which extends radially outwardly from the bottom of the annular portion 73 and includes an upwardly facing surface 81.

Also included in the mounting means are means for securing the clamping member 71 to the lower unit mounting flange 33 so as to engage the annular member 41 with the clamping member 71 and with one or both of inner surface 36 and the surrounding margin of the opening 37 in the mounting plate 35 to provide a water-tight seal. In the illustrated construction, such securing means is provided by a plurality of mounting bolts 83 extending through the lower unit mounting flange 33 and into the upper part of the annular portion 73 of the clamping member 71.

When thus assembled, the extensions or mounts 61, 63 and 65 project between the upper surface of the margin of the opening 37 in the mounting plate 35 and the lower surface of the mounting flange 33 in such manner as to support the weight of the marine propulsion device 13, while also substantially vibrationally isolating the lower unit 19 from the boat hull 11.

While an annular resilient member can be employed to provide the sealing, weight-supporting and vibration-isolating functions in various ways, preferably, the annular portion 43 of the annular member 41 which performs the sealing function is more resilient or softer than the extensions or mounts 61, 63 and 65 so that weight transmittal and vibration dampening occurs primarily in the mounts 61, 63 and 65 as distinguished from the annular portion 43 of the annular member 41. For instance, the annular member 41 could be fabricated so that the extensions or mounts 61, 63 and 65 are of a different composition from the annular portion 73, such that the weight support and vibration isolation functions are primarily performed by the mounts, and such that the annular portion 73 of the annular member 41 serve principally to seal the mounting against entry of water. Alternately, the annular member 41 could be physically constructed so that sealing essentially takes place in a horizontal plane between the outer surface 77 of the clamping member 35 and the inner surface 36 defining the opening 37 in the mounting plate 35 and so that the only engagement of the annular member 41 in the vertical direction occurs between the mounts 61, 63 and 65 and the mounting plate 35 and between the mounts 61, 63 and 65 and one or both of the under surface of the mounting flange 33 on the lower unit 19 and the upper surface 81 of the flange portion 79 of the clamping member 71.

Alternatively, the annular member can be arranged so as to resiliently establish a tight fit between the inner surface 49 which engages the clamping member 71 and the outer surface 53 which engages the mounting plate 35, which inner and outer surfaces are connected by an intermediate or annular or diaphragm portion (not shown) which is incapable of providing either vertical or lateral support, together with the provision of a plurality of extensions or mounts 61, 63 and 65 which extend either between the inner and outer surfaces 49 and 53, or from the outer surface 53 in such manner as to support the weight of the marine propulsion device 13 and to substantially vibrationally isolate the boat hull 11 from the marine propulusion device 13. It is believed that it is within the skill of the art to design the mounts 61, 63 and 65 to obtain the desired performance.

Various of the features of the invention are set forth in the following claims:

What is claimed is:

1. A marine propulsion device comprising a mounting plate adapted to be secured to the bottom of a boat hull in watertight relation and having therein an endless surface defining an opening, and a margin extending from said endless surface, a resilient member comprising an annular sealing portion including an endless surface defining a central opening and a plurality of angularly spaced extension which project outwardly from said annular sealing portion and constitute elastomeric mounts, a clamping member including an annular portion located within said central opening of said resilient member and defining a central opening and a flange portion extending outwardly from said annular portion, a marine propulsion lower unit extending through said opening in said clamping member and including a mounting flange, and means securing said clamping member to said mounting flange with said annular sealing portion of said resilient member located between said mounting plate and at least one of said lower unit mounting flange and said clamping member so as thereby to effect a watertight seal between said mounting plate and at least one of said lower unit mounting flange and said clamping member so as thereby to effect a watertight seal between said lower unit and said mounting plate and with said extension located between said margin of said mounting plate opening and one of said lower unit mounting flange and said clamping member flange so as thereby to support and vibrationally isolate said lower unit from said mounting plate.

2. A marine propulsion device in accordance with claim 1 wherein said sealing portion of said resilient member has greater softness than said extensions.

3. A marine propulsion device in accordance with claim 1 wherein said annular portion of said resilient member includes opposed end surfaces, an inner endless surface extending between said end surfaces and defining said central opening, and an outer endless surface extending between said end surfaces and including therein between said end surfaces an annular recess receiving said margin of said boat hull bottom opening.

4. A marine propulsion device in accordance with claim 3 wherein said recess comprises an annular groove located centrally between said end surfaces.

5. A marine propulsion device in accordance with claim 1 wherein said securing means comprises a plurality of bolts extending through said mounting flange and into said annular portion of said clamping member.

6. A marine propulsion device in accordance with claim 1 wherein said annular portion of said resilient member includes a forward end, a rearward end, and right and left sides extending between said ends, and wherein said plurality of extensions includes a first extension projecting from one of said forward and rearward ends of said annular portion of said resilient member and a pair of extensions projecting respectively from said left and right sides of said annular portion adjacent to the other of said forward and rearward ends.

7. A boat comprising a hull including therein a bottom having therein an endless surface defining an opening, and a margin extending from said endless surface, a resilient member comprising an annular sealing portion including an endless surface defining a central opening and a plurality of angularly spaced extensions which project outwardly from said annular sealing portion and constitute elastomeric mounts, a clamping member including an annular portion located within said central opening of said resilient member and defining a central opening and a flange portion extending outwardly from said annular portion, a marine propulsion lower unit extending through said opening in said clamping member and including a mounting flange, and means securing said clamping member to said mounting flange with said annular sealing portion of said resilient member located between said boat hull bottom and at least one of said lower unit mounting flange and said clamping member so as thereby to effect a watertight seal between said lower unit and said boat hull and with said extensions located between said margin of said boat hull opening and one of said lower unit mounting flange and said clamping member flange so as thereby to support and vibrationally isolate said lower unit from said boat hull.

8. A boat in accordance with claim 7 wherein said sealing portion of said resilient member has greater softness than said extensions.

9. A boat in accordance with claim 7 wherein said boat hull includes a mounting plate having therein said boat hull bottom opening, said mounting plate being engaged by said resilient member to partially provide the watertight seal and to support and vibrationally isolate said lower unit from said boat hull.

10. A boat in accordance with claim 7 wherein said annular portion of said resilient member includes opposed end surfaces, an inner endless surface extending between said end surfaces and defining a central opening, and an outer endless surface extending between said end surfaces and including therein between said end surfaces an annular recess receiving said margin of said boat hull bottom opening.

11. A boat in accordance with claim 10 wherein said recess comprises an annular groove located centrally between said end surfaces.

12. A boat in accordance with claim 7 wherein said securing means comprises a plurality of bolts extending through said mounting flange and into said annular portion of said clamping member.

13. A boat in accordance with claim 7 wherein said annular portion of said resilient member includes a forward end, a rearward end, and right and left sides extending between said ends, and wherein said plurality of extensions includes a first extensions projecting from one of said forward and rearward ends of said annular portion of said resilient member and a pair of extensions projecting respectively from said left and right sides of said annular portion adjacent to the other of said forward and rearward ends.

14. A marine propulsion device adapted to be supported in a boat hull and to extend through an opening in the bottom of the boat hull, said device comprising a marine propulsion lower unit extending through the opening in the boat hull and including a mounting flange, a clamping member including an annular portion located within the opening in the boat hull and defining a central opening through which said lower unit extends, said clamping member also including a flange portion extending outwardly from said annular portion, a resilient member including an annular sealing portion having an endless surface defining a central opening located outwardly of said annular portion of said clamping member, said resilient member also including a plurality of angularly spaced extensions which project from said annular sealing portion and constitute elastomeric mounts, and means securing said clamping member to said mounting flange with said annular sealing portion of said resilient member located between said mounting flange of said lower unit and said flange portion of said clamping member.

* * * * *

PO-1050
(5/69)

UNITED STATES PATENT OFFICE
CERTIFICATE OF CORRECTION

Patent No. 3,982,496 Dated September 28, 1976

Inventor(s) Clarence E. Blanchard

It is certified that error appears in the above-identified patent and that said Letters Patent are hereby corrected as shown below:

| | |
|---|---|
| Column 4, line 18 | delete "34", insert ---35--- |
| Column 4, line 46 | delete "sealng", insert ---sealing---. |
| Column 6, line 20 | delete "extension", insert ---extensions---. |
| Column 6, line 37 | delete "extension", insert ---extensions---. |

Signed and Sealed this

Eleventh Day of January 1977

[SEAL]

*Attest:*

RUTH C. MASON
*Attesting Officer*

C. MARSHALL DANN
*Commissioner of Patents and Trademarks*